US007417520B2

(12) United States Patent
Kralik

(10) Patent No.: US 7,417,520 B2
(45) Date of Patent: Aug. 26, 2008

(54) CONTACTOR FOR DIRECT CURRENT AND ALTERNATING CURRENT OPERATION

(75) Inventor: Robert Kralik, Poing (DE)

(73) Assignee: Schaltbau GmbH, Munich (DE)

( * ) Notice: Subject to any disclaimer, the term of this patent is extended or adjusted under 35 U.S.C. 154(b) by 0 days.

(21) Appl. No.: 11/882,244

(22) Filed: Jul. 31, 2007

(65) Prior Publication Data

US 2008/0030289 A1 Feb. 7, 2008

(30) Foreign Application Priority Data

Aug. 1, 2006 (DE) ..... 10 2006 035 844

(51) Int. Cl.
*H01H 9/30* (2006.01)

(52) U.S. Cl. ..... 335/201; 200/10; 218/22; 218/23; 218/28

(58) Field of Classification Search ..... 335/201; 200/10; 218/22–28
See application file for complete search history.

(56) References Cited

U.S. PATENT DOCUMENTS 2,875,303 A 2/1959 Immel et al.

FOREIGN PATENT DOCUMENTS

| | | |
|---|---|---|
| CH | 382256 | 11/1964 |
| DE | 958 401 C | 2/1957 |
| DE | 1 246 851 | 2/1967 |
| DE | 1 962 559 | 6/1967 |
| DE | 2 329 730 | 1/1974 |
| DE | 78 35 288 | 3/1979 |
| DE | 298 23 717 U1 | 11/1999 |
| EP | 0 980 085 B1 | 11/2006 |
| GB | 998482 | 7/1965 |

*Primary Examiner*—Ramon M Barrera
(74) *Attorney, Agent, or Firm*—Finnegan, Henderson, Farabow, Garrett & Dunner, L.L.P.

(57) ABSTRACT

The invention relates to a contactor for direct current and alternating current operation with at least one contact point with a fixed contact and a movable contact, at least one permanent magnet, arranged adjacent to the contact point, for the generation of a permanent magnetic blowout field and at least one coil, arranged adjacent to the contact point, for the generation of an electromagnetic blowout field, for blowing an arc that is formed when opening the contact point into at least one arc chamber. A contactor is to be provided that allows a quick and reliable separation of the contacts and consequently also a quick and reliable extinguishing of the arcs and that allows a structure with a simple design and simple manufacture. For this purpose, the contactor has at least two contact points, wherein the movable contacts are arranged on a contact bridge, at least one permanent magnet is arranged adjacent to each contact point and the permanent magnets assigned to the two contact points are polarised in opposite directions.

5 Claims, 3 Drawing Sheets

CONTACTOR FOR DIRECT CURRENT AND ALTERNATING CURRENT OPERATION

Figure 1:
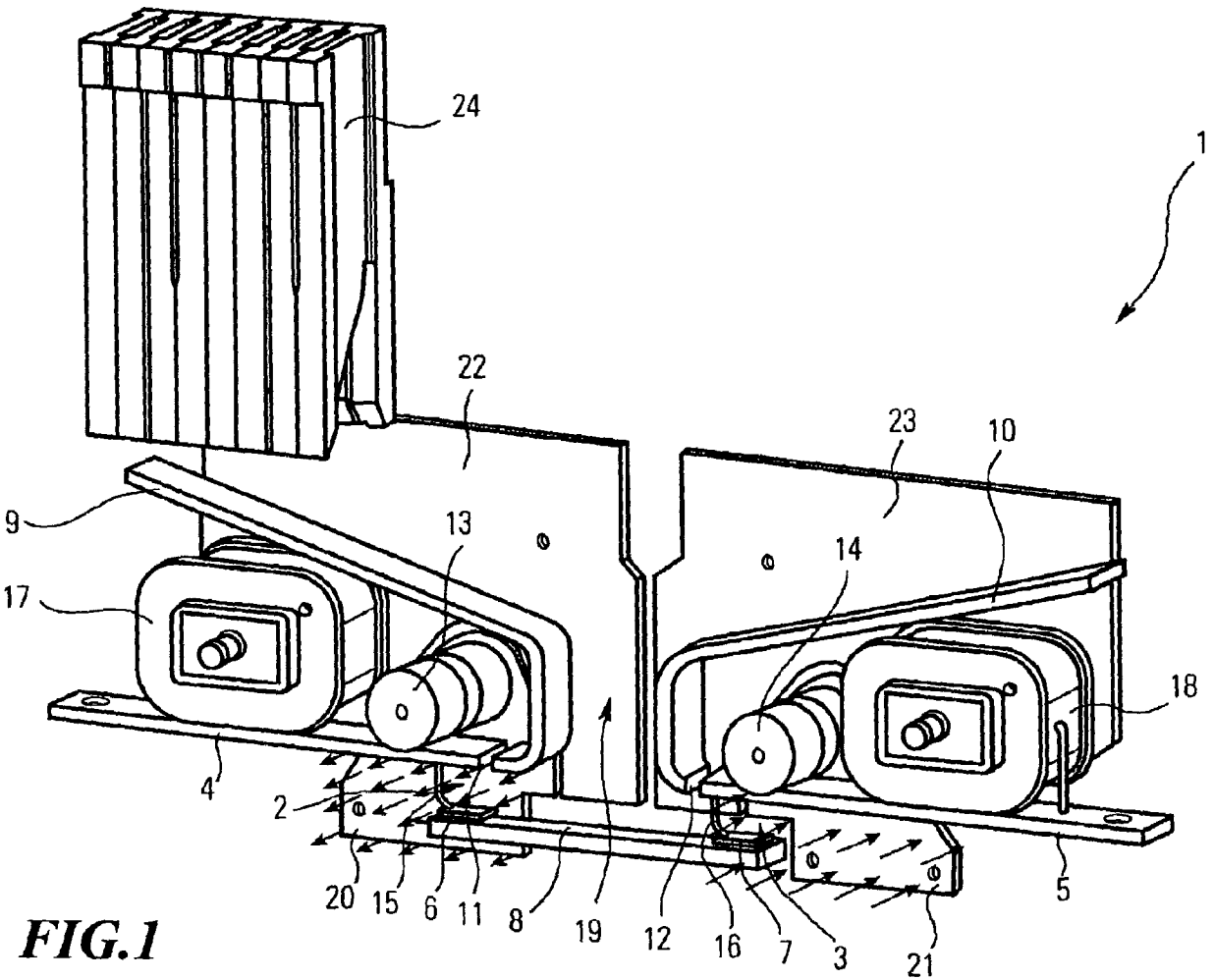

The invention relates to a contactor for direct current and alternating current operation with at least one contact point with a fixed contact and a movable contact, at least one permanent magnet, arranged adjacent to the contact point, for the generation of a permanent magnetic blowout field and at least one coil, arranged adjacent to the contact point, for the generation of an electromagnetic blowout field, for blowing an arc that is formed when opening the contact point into at least one arc chamber.

Such contactors are used, for example, in railway systems for switching loads and for interrupting electric circuits with large currents or high voltages. During the switching operation, i.e., when the contact points are opened, an arc is formed between the fixed contact and the movable contact. The current flowing between the contacts is maintained by means of this arc. Moreover, a large quantity of heat is released by the arc, which results in the erosion of the contacts, consequently reducing the life cycle of the contactor. Furthermore, the entire device area affected by the arc influence is subjected to a very large thermal load. For this reason, a quick extinguishing of the arc is required.

Depending on the application, various methods for extinguishing an arc are known: A contactor for use in direct current operation with a constant direction of current normally has permanent magnetic blowout fields that are arranged in such a way that the direction of the magnetic field is perpendicular to the arc. The blowout fields exert a force on the arc, the Lorentz force, by means of which the arc is driven in the direction of an arc chamber.

For bidirectional direct current operation, such as is known, for example, in the recuperation from the tram field or in ICEs, with a number of alternatingly active pantographs, and for alternating current operation, no purely permanent magnetic fields can be used due to the alternating direction of current in the arcs. In these fields, therefore, the use of so-called blowout coils is customary, which coils generate an electromagnetic blowout field. The direction of the electromagnetic blow out field is determined by the direction of current. Regardless of the direction of current, the result is a correctly directed force on the arc in every case.

The use of coils brings with it a number of disadvantages, however. If high currents permanently flow through the coil, as is customary in the railway sector, the result is considerable heating. It is known, therefore, to delay activating the coil until the moment of the shutoff. The coil, however, builds up the electromagnetic blowout field with a time delay (E-function), as a result of which the dwell time of the arc in the contactor's contact zone is extended.

In the case of small currents, on the other hand, the coil builds up only a small blowout field. As a result, it can happen that the blowout field is not sufficient for driving the arc into the arc chamber and for bringing about the extinguishing of the arc (critical current range).

A single-break circuit breaker is known from DE 298 23 717 U1 in which a permanent magnet and a coil are combined for the generation of a blowout field. The contact or break point of the circuit breaker comprises a fixed contact that is connected to a first input lead and a movable contact that is connected to a second input lead via a wire. A permanent magnet and a blowout coil are arranged in the area around the contact point, wherein the blowout coil is connected to the same input lead as is the movable contact. When the contact point is opened, the movable contact is moved into a catching shoe which is electroconductively connected to the coil. The resulting arc is blown via the blowout field generated by the permanent magnet in the direction of the catching shoe, and jumps over to this shoe. Because the catching shoe is electroconductively connected to the coil, the coil is activated in this way. The coil then builds up an electromagnetic blowout field that blows the arc into an arc chute.

Detrimental in this circuit breaker is the fact that the movable contact must be connected to the input lead with a flexible wire, and the fact that the movable contact has a large opening stroke. Moreover, the catching shoe has a complex geometry and must surround the movable contact on at least two opposing sides.

The object of the present invention is therefore to provide a contactor that can be used for direct current operation, bidirectional direct current operation and alternating current operation, and that effects a quick extinguishing of the arc with the exclusion of a critical current range. At the same time, a structure with a simple design and therefore economical manufacture must be taken into consideration.

Said object is achieved according to the invention by the features that the contactor has at least two contact points, wherein the movable contacts are arranged on a contact bridge, at least one permanent magnet is arranged adjacent to each contact point and the permanent magnets assigned to the two contact points are polarised in opposite directions.

The permanent magnets generate permanent magnetic blowout fields in the area of the two contact points, with said blowout fields being polarised in opposite directions. Consequently, permanent magnetic blowout fields act immediately on the two arcs that are formed when the contact points are opened. Because the direction of current in the arc at the first contact point is opposite to the direction of current in the arc at the second contact point, the two arcs are driven in the same direction by the two permanent magnetic blowout fields. In this way, one of the arcs is always blown in the direction of the electromagnetic blowout areas and the arc chamber by the permanent magnetic blowout fields, regardless of the direction of current.

Because two movable contacts are provided, only half of an opening stroke is required in comparison to a single break. It is therefore possible to do away with costly and space-consuming mechanics for enlarging the working stroke of the magnetic drive. As a result of the arrangement of the movable contacts oh the contact bridge, a straight opening movement is made possible, and so it is possible to do without a flexible wire.

In one embodiment, it may be provided an arc guide plate being arranged adjacent to each contact point and isolated from the fixed contacts, and the respective blowout coil being electroconductively connected to the respective fixed contact and the respective arc guide plate. The coils are not activated until the arcs, which are formed when the contact points are opened, are blown by the strong permanent magnetic blowout fields and jump from the fixed contacts to the arc guide plates. This allows a relatively small dimensioning of the coils and avoids overheating.

According to a further embodiment, pole plates arranged adjacent to the contact points can be assigned to the permanent magnets. As a result of the pole plates, an enlarged, uniform permanent magnetic blowout field is generated that particularly acts in the area of the contact points. Consequently, the permanent magnetic blowout fields immediately act on the arcs that are formed when the contacts are opened and drive the arcs quickly out of the contact points, thus reducing contact erosion.

Furthermore, there may be provided pole plates being assigned to the blowout coils and these pole plates being arranged adjacent to the arc guide plates. The coils are not activated until the arcs jump over to the arc guide plates after running through the permanent magnetic areas. A homogenous electromagnetic blowout field is built up by the pole plates of the coils in the area of the arc guide plates and in the arc extinguishing area. The arcs found on the arc guide plates are consequently driven away from the permanent magnetic areas and stretched, independently of the direction of current.

According to a further development, exactly one arc chamber is arranged adjacent to the arc guide plates. The arcs are driven into the arc chamber by the blowout fields where they are stretched and cooled and consequently extinguished. The arc chamber can, for example, comprise arc extinguishing blades or ceramic bodies arranged parallel and next to one another. Because the arcs of both contact points are blown into the same arc chamber, depending on the direction of current, a space-saving structure of the contactor is possible.

Figure 2:
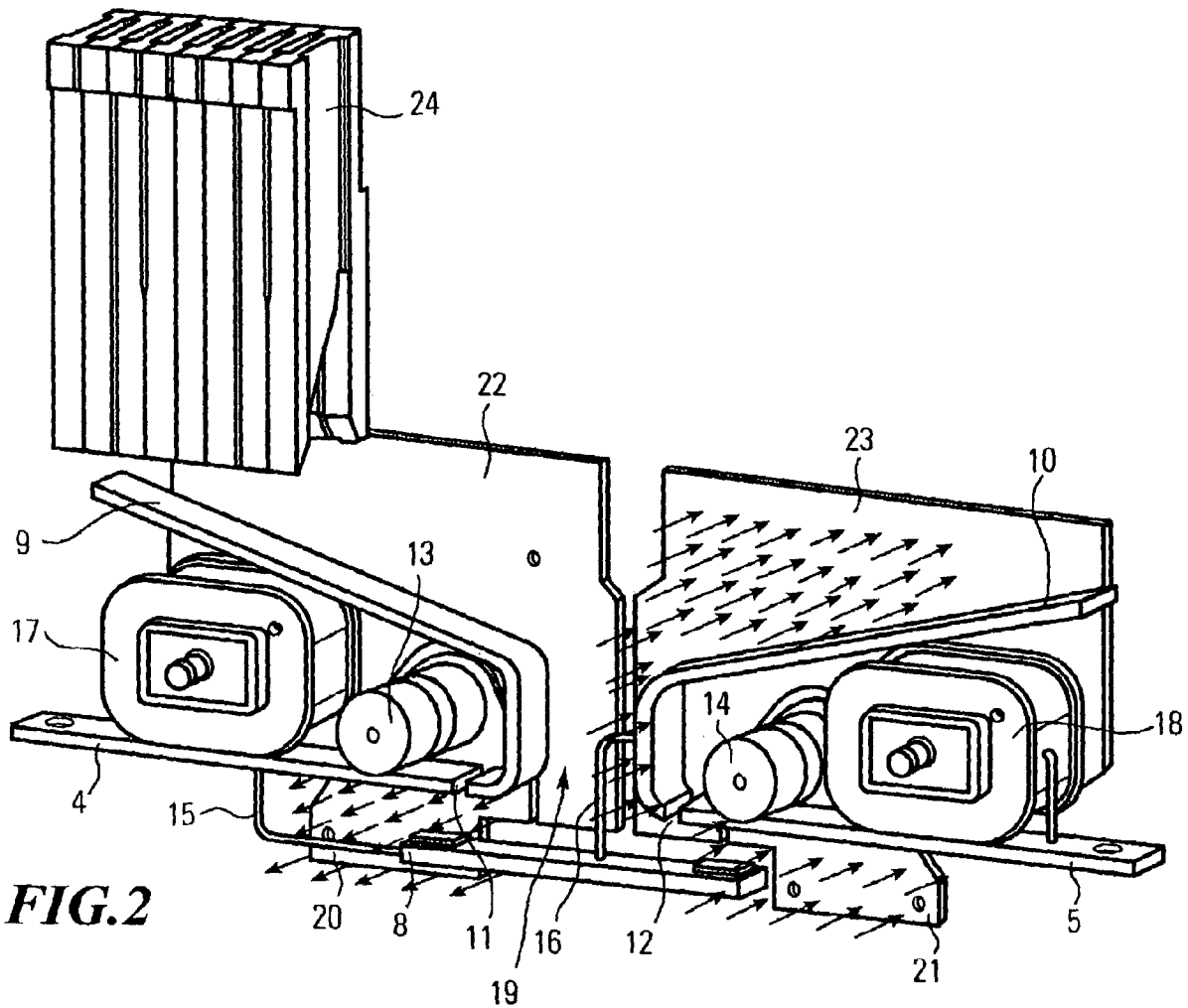
Figure 3:
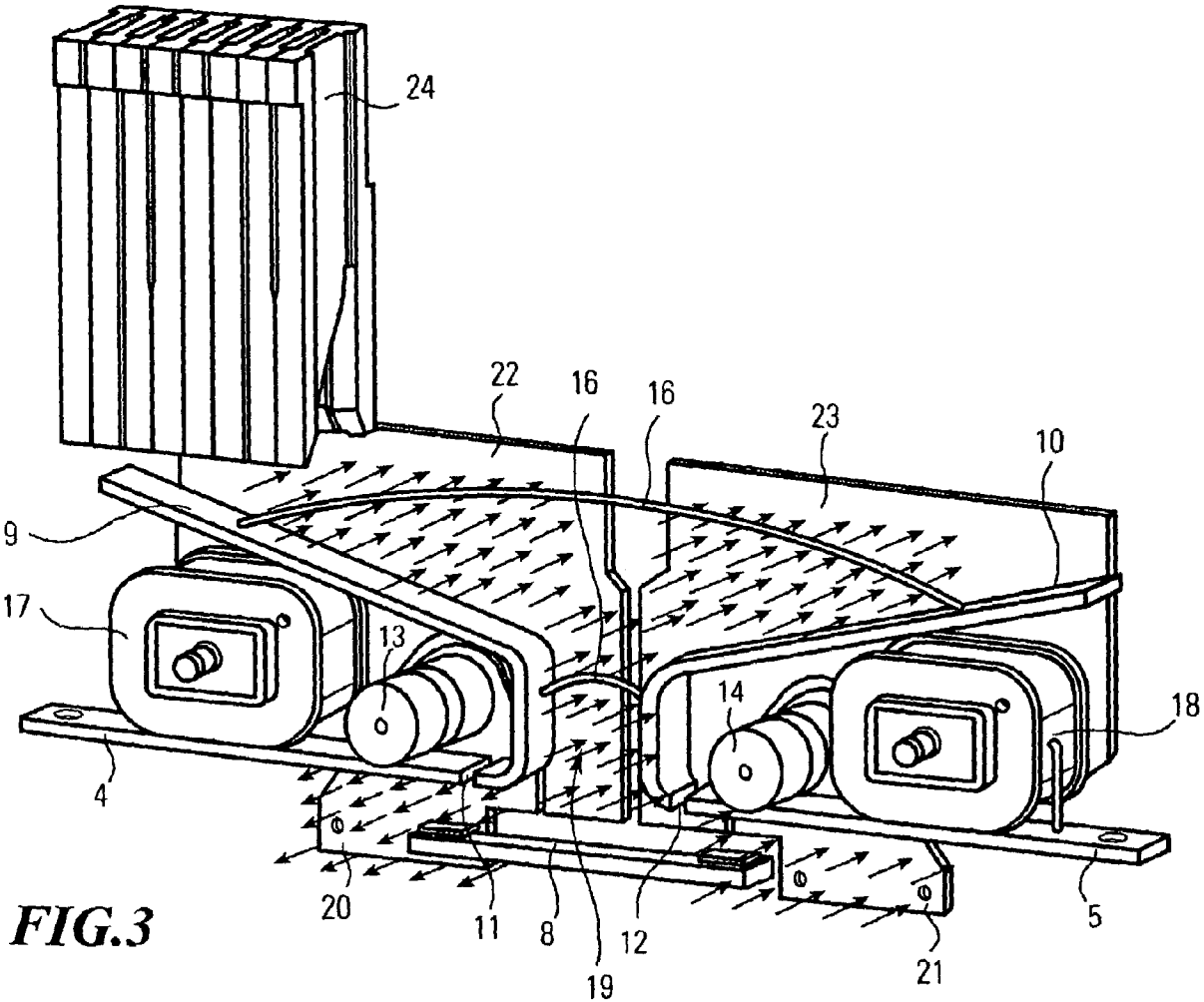

In the following, embodiments of the invention are explained in more detail using a drawing. Shown are:

FIG. 1 a perspective partial view of a contactor in section at the time of opening of the contact points, FIG. 2 a perspective partial view of a contactor in section after activation of the first blowout coil, FIG. 3 a perspective partial view of a contactor in section after activation of the second blowout coil.

FIG. 1 shows a perspective view of the interior of a contactor 1. The contactor comprises two contact points 2, 3, each with a fixed contact 4, 5 and each with a movable contact 6, 7. The movable contacts 6, 7 are arranged on a one contact bridge 8. The contact bridge 8 can be moved via a magnetic drive (not shown) and can be transferred from a closed position in which the movable contacts 6, 7 touch the fixed contacts 4, 5 into an open position. In the open position, the movable contacts 6, 7 are separated from the fixed contacts 4, 5. An arc guide plate 9, 10 is arranged adjacent to the fixed contacts 4, 5 at each contact point 2, 3. Each of the arc guide plates 9, 10 is isolated from the fixed contacts 4, 5 by an air gap 11, 12. Furthermore, at least one permanent magnet 13, 14 is arranged at each contact point 2, 3. The permanent magnets 13, 14 are arranged in such a way that their magnetic field is perpendicular to the arcs 15, 16 which are formed when the contact points 2, 3 are opened. The direction of the magnetic field of the permanent magnet 13 arranged at the contact point 2 is opposite to the direction of the magnetic field of the permanent magnet 14 arranged on the contact point 3.

The contactor 1 furthermore comprises two coils 17, 18 that are arranged adjacent to the permanent magnets 13, 14. The coil 17 is electroconductively connected to the fixed contact 4 of the contact point 2 and the arc guide plate 9 arranged adjacent to it. The coil 18 is likewise electroconductively connected to the fixed contact 5 of the contact point 3 and the arc guide plate 10.

The arc guide plates 9, 10 are formed in such a way that they form, adjacent to the contact points 2, 3, an arc guide shaft 19 that runs essentially perpendicularly to the contact bridge 8 and through which the arcs 15, 16 are blown by the blowout fields of the coils 17, 18. The arc guide plates 9, 10 expand following this arc guide shaft 19. An arc chamber 24 is arranged adjacent to the arc guide plates 9, 10.

A pair of pole plates 20 is assigned to the permanent magnet 13 arranged at the contact point 2, whereby the two pole plates are located on opposite sides of the contact bridge 8. Because the contact point 3 is formed in a manner essentially analogous to a contact point 2, a pair of pole plates 21 is likewise assigned to the permanent magnet 14, with the pole plates being located on opposite sides of the contact bridge 8. FIG. 1 shows only one pole plate of the pairs of pole plates 20, 21 for each contact point 2, 3. The pole plates of the pairs of pole plates 20, 21 are made of magnetisable material and are polarised by the permanent magnets 13 or the permanent magnets 14, respectively, and consequently generate a homogenous permanent magnetic blowout field. The pairs of pole plates 20, 21 are formed in such a way that the magnetic fields that they generate penetrate the area of the contact points 2, 3.

A pair of pole plates 22 is assigned to coil 17 and a pair of pole plates 23 is assigned to coil 18. The pole plates of the pairs of pole plates 22, 23 are formed in such a way that they extend particularly over the area of the arc guide shaft 19 and the arc guide plates 9, 10. Because the coils 17, 18 are not activated until the first arc root jumps over to one of the arc guide plates 9, 10, the electromagnetic blowout fields must particularly act in this area.

In the following, the processes in the contactor 1 when the contact points 2, 3 are opened are described using FIGS. 1 to 3.

FIG. 1 shows the contactor at the moment of opening. The contact bridge 8 is moved down by means of the magnetic drive (not shown) so that the movable contacts 6, 7 arranged on this contact bridges are separated from the fixed contacts 4, 5. Thus, the arcs 15, 16 are formed at the contact points 2, 3. The permanent magnetic blowout field generated by the permanent magnet 13 and the pole plates 20, as well as the permanent magnetic blowout field generated by the permanent magnet 14, which is polarised in an opposite, direction, and the pole plates 21 act on the arcs 15, 16 immediately.

This is shown in FIG. 2. Because the direction of current in the arc 15 is opposite to that of the arc 16, the two arcs 15, 16 are blown in the same direction, in the case shown, to the left, by the permanent magnetic blowout fields. The arc 16 is consequently blown in the direction of the arc guide shaft 19 and jumps over the air gap 12. The electric circuit in the contactor is now still closed, and the current flows from the fixed contact 4 via the arc 15, the contact bridge 8, the arc 16, the arc guide plate 10 and the coil 18 to the fixed contact 5. The coil 18 is consequently activated by arc 16 jumping over to the arc guide plate 10, and now generates an electromagnetic blowout field, which likewise acts on the arc 16. This leads to the second arc root of the arc 16 generally jumping over from the contact bridge 8 to the arc guide plate 9 (see FIG. 3). The arc 15 is extinguished.

The electric circuit in the contactor 1 is now still closed, whereby the current flows from the fixed contact 4, via the coil 17, the arc guide plate 9, the arc 16, the arc guide plate 10 and the coil 18 to the fixed contact 5. As a result of the second arc root of the arc 16 jumping from the contact bridge 8 over to the arc guide plate 9, the coil 17 is now also activated so that it likewise generates an electromagnetic blowout field. In this way, the arc 16 is blown out of the arc guide shaft 19 and expands at the arc guide plates 9, 10, until it is finally extinguished in the arc chamber 24.

In the case of very small currents and simultaneously high voltages (critical current range), it can happen that the electromagnetic blowout field of the coil 18 is not sufficient for the second arc root of the arc 16 to jump from the contact bridge 8 to the arc guide plate 9. The arc 15 is not immediately extinguished in this case and continues to burn in series connection to the arc 16. In this case, the arc 15 is further stretched by the permanent magnetic blowout field of the permanent magnet 13 until extinguishing. As soon as the arc 15 is extinguished, the arc 16 is also extinguished. The permanent magnet 13 consequently advantageously contributes to the mastering of the critical current range.

If the direction of current in the contactor at the moment of opening is opposite to the cases described above, the arc 15 is guided into the arc guide shaft 19 instead of the arc 16, and first jumps over to the arc guide plate 9. The rest of the arc extinguishing process continues in a manner analogous to the examples described above.

The contactor 1 can also be used for alternating current operation, because when one of the arcs 15, 16 jumps over to the arc guide plates 9, 10, one of the coils 17, 18 is activated, which generates an electromagnetic blowout field whose direction changes with the direction of current, consequently always leading to the corresponding arc 15, 16 being driven into the arc chamber 24 and extinguished there. The permanent magnets 13, 14 are selected in such a way that in alternating current operation, either the arc 15 or the arc 16 is blown on the respective arc guide plate 9, 10 during a half-wave and the corresponding coil 17, 18 is activated. When the direction of current changes in the next half-wave, the direction of the electromagnetic blowout field is also inverted and the arc is further blown in the direction of the arc chamber 24.

The invention claimed is:

1. A contactor for direct current and alternating current operation comprising at least two contact points with a fixed contact and a movable contact, at least one permanent magnet is arranged adjacent to each contact point for the generation of a permanent magnetic blowout field, and at least one coil arranged adjacent to each contact point for the generation of an electromagnetic blowout field, for blowing an arc that is formed when opening the contact points into at least one arc chamber, wherein the movable contacts are arranged on a contact bridge, and the permanent magnets assigned to the two contact points are polarized in opposite directions.

2. The contactor according to claim 1, wherein an arc guide plate is arranged adjacent to each contact point and isolated from the fixed contacts and the respective coil is electroconductively connected to the respective fixed contact and the respective arc guide plate.

3. The contactor according to claim 1 or 2, wherein pole plates arranged adjacent to the contact points are assigned to the permanent magnets.

4. The contactor according to claim 2, wherein pole plates are assigned to the coils and these pole plates are arranged adjacent to the arc guide plates.

5. The contactor according to claim 2, wherein exactly one arc chamber is arranged adjacent to the arc guide plates.

* * * * *